US005823211A

United States Patent [19]

Wilhelmstätter et al.

[11] Patent Number: 5,823,211

[45] Date of Patent: Oct. 20, 1998

[54] DISHWASHER

[75] Inventors: Johann Wilhelmstätter, Giengen/Hürben; Helmut Jerg, Giengen; Bernd Schessl, Dillingen; Gerhard Fetzer, Gundelfingen; Michael Hartmann, Höchstädt; Markus Höpfl, Lauingen/Donau; Karl-Heinz Rehm, Dischingen; Rudolf Schmidt, Giengen, all of Germany

[73] Assignee: BSH Bosch und Siemens Hausgeraete GmbH, Munich, Germany

[21] Appl. No.: 821,082

[22] Filed: Mar. 20, 1997

[30] Foreign Application Priority Data

Mar. 20, 1996 [DE] Germany ..... 196 11 054.8

[51] Int. Cl.[6] ..... B08B 3/02

[52] U.S. Cl. ..... 134/176; 134/174; 134/180; 134/201; 239/265

[58] Field of Search ..... 134/56 D, 57 D, 134/58 D, 176, 179, 180, 200, 201; 239/251, 264, 265

[56] References Cited

U.S. PATENT DOCUMENTS

| | | | |
|---|---|---|---|
| 3,538,927 | 11/1970 | Wallgren | 134/180 |
| 4,179,307 | 12/1979 | Cau et al. | 134/58 D |
| 5,115,822 | 5/1992 | Nichols | 134/201 |
| 5,595,200 | 1/1997 | Favaro | 134/201 |

FOREIGN PATENT DOCUMENTS

| | | | |
|---|---|---|---|
| 2544606 | 10/1984 | France | 134/56 D |
| 2732665 | 2/1975 | Germany | 134/179 |
| 2355271 | 5/1975 | Germany | 134/179 |
| 3540238 | 5/1987 | Germany | 134/201 |
| 4137227 | 5/1993 | Germany | 134/58 D |
| 2267429 | 12/1993 | United Kingdom | 134/58 D |

*Primary Examiner*—Frankie L. Stinson
*Attorney, Agent, or Firm*—Herbert L. Lerner; Laurence A. Greenberg

[57] ABSTRACT

A dishwasher includes at least one adjustable-height basket to which an associated spray arm and its inlet tube are secured. The inlet tube is disposed horizontally and is connected by a coupling to a supply line secured to a side wall of a tub. An open connection fitting and two closed blind fittings protrude toward the inlet tube. The coupling has two openings into which the connecting fitting and one of the blind fittings respectively protrude. In order to provide a simple way of assuring the joining together of the coupling to the fittings, and to assure that pressure losses in the water supply to the spray arm connected to the coupling through the use of the supply and resultant worsening of the cleaning action are effectively avoided, regardless of how the basket is loaded, the coupling has an end oriented toward the supply line with a centering plate and downstream thereof a sealing plate having flexible sealing lips and being freely movable between a housing of the coupling and the centering plate.

13 Claims, 1 Drawing Sheet

32
9
8
10
11
12
22
27
3
26
4
6
21
30
31
18
14
20
25
17
16
15
13
II
III
5
7
2
1

12
18
14
20
25
19
15
28
23
13

3
27
22
24
20
25
15
29
17
2

DISHWASHER

BACKGROUND OF THE INVENTION

Field of the Invention

The invention relates to a dishwasher, having at least one adjustable-height basket to which an associated spray arm and its inlet tube are secured, the inlet tube is disposed horizontally and is connected by a coupling to a supply line secured to a side wall of a tub, an open connection fitting protrudes toward the inlet tube, two closed blind fittings protrude toward the inlet tube, and the coupling has two openings into which the connecting fitting and one of the blind fittings respectively protrude.

In a dishwasher of the type referred to at the outset, which is known from German Published, Non-Prosecuted Patent Application DE-OS 23 55 271, when the basket is inserted, the coupling is found because of the conical shaping of the two openings, the connection fitting and the blind fittings, and the two openings are sealed off merely as a result of the contact of the inlet tube secured to the basket, with the supply line, and due to the conical construction of the two openings, the connection fitting and the blind fittings. Due to the bending of the basket which can vary depending on the load, and the attendant different position of the inlet tube, as well as production variations of the basket and its guides, surface roughness, etc., difficulties occur in joining the coupling to the appropriate fitting, and it is virtually impossible to operate that coupling, at the water pressures that prevail in the water supply to a dishwasher, without the escape of liquid at the coupling points. That escape of liquid in the coupling, while not causing liquid losses in a closed tub, nevertheless causes pressure losses in the water supply to the spray arm connected through the use of the supply to the coupling, leading to worse cleaning results.

SUMMARY OF THE INVENTION

It is accordingly an object of the invention to provide a dishwasher, which overcomes the hereinafore-mentioned disadvantages of the heretofore-known devices of this general type, in which an assured joining together of a coupling and fittings is possible regardless of the way in which a basket is loaded, and in which pressure losses in a water supply to a spray arm connected to the coupling through the use of the supply and resultant worsening of cleaning action are effectively avoided.

With the foregoing and other objects in view there is provided, in accordance with the invention, a dishwasher, comprising a tub having a side wall; at least one adjustable-height basket; a spray arm associated with the basket, the spray arm having a horizontal inlet tube, and the spray arm and the inlet tube being secured to the basket; a supply line secured to the side wall of the tub; an open connection fitting protruding toward the inlet tube; two closed blind fittings protruding toward the inlet tube; and a coupling having a housing, the coupling having an end oriented toward the supply line, the coupling connecting the inlet tube to the supply line, the coupling having two openings formed therein, the connection fitting protruding into one of the openings, and one of the blind fittings protruding into the other of the openings, the coupling having a centering plate at the end and a sealing plate downstream of the centering plate in flow direction, and the sealing plate having flexible sealing lips and being freely movable between the housing and the centering plate.

Displacements of the coupling from the varying position of the coupling, depending on the varying load of the basket, upon joining of the coupling together with the fitting of the supply tube, are compensated for through the use of the sealing plate, which is movable in all directions. When water pressure occurs in the coupling, it causes a sealing contact of the flexible sealing lips with the connection fittings and the inward-protruding blind fittings as well as the centering plate, thus effectively preventing water losses. With the configuration according to the invention, a dishwasher of the type referred to at the outset is created in a simple way in which, regardless of how the basket is loaded, an assured joining together of the coupling to the fittings is possible, and in which pressure losses in the water supply to the spray arm connected to the coupling through the use of the supply and resultant worsening of the cleaning action are effectively avoided.

In accordance with another feature of the invention, the openings have a conical shape that narrows toward the interior of the coupling. When water pressure occurs in the coupling, it brings about a sealing contact of the cones with the inward-protruding fittings, thus improving the seal.

In accordance with a further feature of the invention, a flexible plate with sealing lips is inserted into the sealing plate, which enables simple manufacture.

In accordance with an added feature of the invention, the flexible plate is made of rubber, which results in further facilitation of manufacture.

In accordance with an additional feature of the invention, the flexible sealing lips are formed onto the sealing plate, and alternatively in accordance with yet another feature of the invention, the sealing plate has a coating of flexible material that has the flexible sealing lips. Both embodiments offer further possibilities of creating the sealing function of the sealing plate through the use of simple manufacture.

In accordance with yet a further feature of the invention, the blind fittings have conical tips that protrude in front of the free end of the connection fitting, thus creating additional guidance for easier introduction of the fittings into the coupling.

In accordance with yet an added feature of the invention, the centering plate is secured with snap connections in the housing of the coupling, thus achieving simple assembly of the apparatus.

In accordance with yet an additional feature of the invention, there are provided detent buttons that drop into detent openings of the housing and are disposed on an encompassing rim of the centering plate, which results in further simplification of production and assembly.

In accordance with again another feature of the invention, the centering plate is sealed off from the housing of the coupling through the use of a labyrinthine sealing assembly, thus averting one further cause of possible water loss.

In accordance with again a further feature of the invention, the labyrinthine sealing assembly is formed by the encompassing rim of the centering plate and by a sealing edge of the housing of the coupling encompassing the inside of the encompassing rim of the centering plate, thus assuring simple manufacture.

In accordance with again an added feature of the invention, the housing of the coupling is made integrally with the inlet tube, which results in further simplification of the apparatus according to the invention.

In accordance with a concomitant feature of the invention, the housing of the coupling has receptacles and counter holders for longitudinal wires of the basket, thus attaining simple assembly of the apparatus of the invention.

Other features which are considered as characteristic for the invention are set forth in the appended claims.

Although the invention is illustrated and described herein as embodied in a dishwasher, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BREIF DESCRIPTION OF THE DRAWING

DESCRIPTION OF THE PREFERRED EMBODIMENTS

Figure 1:
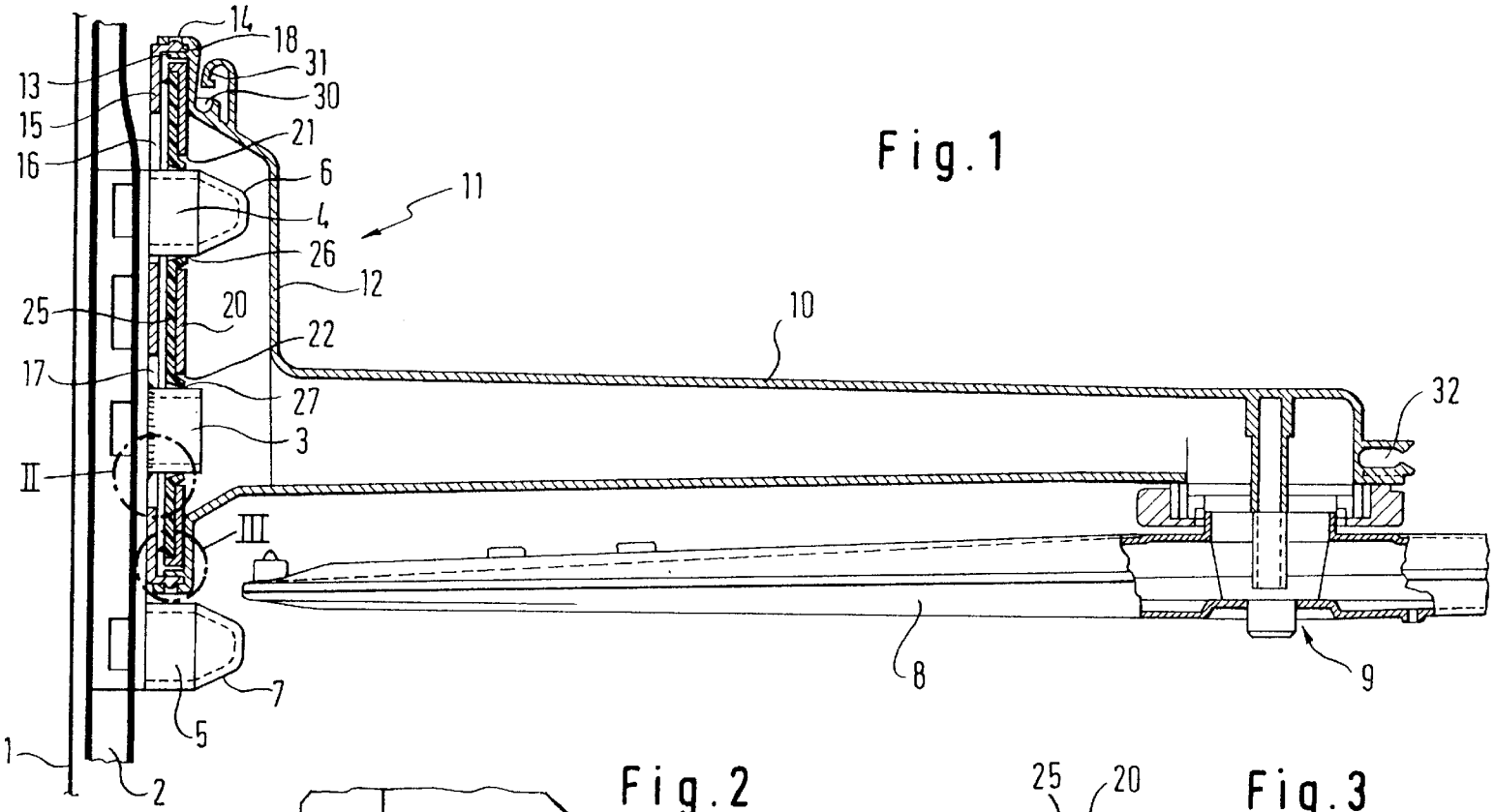
FIG. 1 is a fragmentary, diagrammatic, partly broken-away and partly-sectional, side-elevational view of a dishwasher according to the invention.

Referring now to the figures of the drawings in detail and first, particularly, to FIG. 1 thereof, there is seen an exemplary embodiment of a dishwasher according to the invention which is not identified by a reference numeral and which has a non-illustrated adjustable-height basket to which an associated spray arm 8 and an inlet tube 10 thereof are secured. The spray arm 8 is supported on the horizontally disposed inlet tube 10 through the use of a bearing 9, which is not shown in further detail. According to the invention, the inlet tube 10 is connected through the use of a coupling 11 to a supply line 2 which is secured to a side wall of a tub. In the illustrated exemplary embodiment the supply line 2 is secured at a back wall 1 of the tub. The supply line 2 has an open connection fitting 3 protruding in the direction toward the inlet tube 10 and two closed blind fittings 4, 5 protruding in the direction of the inlet tube 10. The blind fittings 4, 5 have conical tips 6, 7, which protrude in front of a free end of the connection fitting 3.

Figure 3:
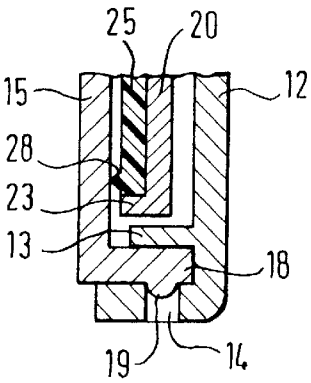
FIG. 3 is a fragmentary, enlarged view of a portion III of FIG. 1.

The coupling 11 of the inlet tube 10 has a housing 12, which is made integral with the inlet tube 10 in the exemplary embodiment, and into which a centering plate 15 is snapped vertically, essentially parallel to the supply line 2, through the use of detent connections, in order to act as a front closure of the coupling 11 in the position for use. As is best seen in FIG. 3, these detent connections are formed by detent buttons 19 disposed on an encompassing rim 18 of the centering plate 15. Upon assembly, the detent buttons 19 drop into detent openings 14 in the housing 12. The centering plate 15 is sealed off from the housing 12 of the coupling 11 through the use of a labyrinthine sealing assembly. The sealing assembly is formed by the encompassing rim 18 of the centering plate 15 and by a sealing edge 13 of the housing 12 of the coupling 11 encompassing the inside of the encompassing rim 18 of the centering plate 15.

Figure 2:
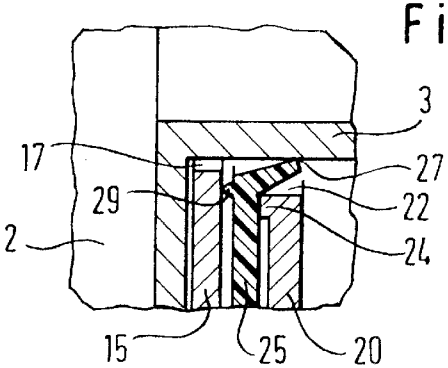
FIG. 2 is a fragmentary, enlarged view of a portion II of FIG. 1.

According to the invention, the coupling 11 has an end oriented toward the supply line on which the centering plate 15 and a sealing plate 20 downstream thereof in flow direction are disposed. The sealing plate 20 has flexible sealing lips 28, 29 that are best seen in FIGS. 2 and 3 and in the illustrated exemplary embodiment it is constructed as a sealing plate 20 which has an inserted flexible plate 25 and which is freely movable between the housing 12 of the coupling 11 and the centering plate 15. The flexible plate 25 is made of rubber in the illustrated exemplary embodiment. The sealing plate 20 has an outer rim 23 which is drawn forward and encompassingly surrounds the periphery of the flexible plate 25. The encompassing sealing lip 28 which is part of the flexible plate 25 and which rests on the centering plate 15, is adjacent the encompassing rim 23 of the sealing plate 20. The above-mentioned plates 15, 20 and 25 of the coupling 11 each have two respective openings 16 and 17; 21 and 22; and 26 and 27. The connection fitting 3 and one of the blind fittings 4, 5 of the supply line 2, namely the upper blind fitting 4 in the case of the position of the exemplary embodiment shown in FIG. 1, protrude into each of the openings. The two openings 26, 27 in the flexible plate 25 have a conical shape that narrows toward the interior of the coupling 11, as can be best seen in FIG. 2. These openings 26, 27 are each surrounded by an encompassing rim 24 of the sealing plate 20. The sealing lips 28, 29 of the flexible plate 25, which encompass the openings 26, 27 and rest on the centering plate 15, are adjacent the end of the openings 26, 27.

The housing also has a receptacle 30, adjacent a front end of the centering plate 15, with a counter holder 31 that is constructed as a resilient hook in the exemplary embodiment. The housing 12 has a further receptacle 32 on a rear end, adjacent the bearing 9 of the spray arm 8. The receptacles are integrally formed onto the housing 12, for securing the supply tube 10 to longitudinal wires 33 of the basket.

Before the dishwasher is put into operation, after the basket has been loaded with dishes or the like to be cleaned, the basket is thrust into the tub on non-illustrated guides. In the process, first the conical tip 6, 7 of one of the blind fittings 4, 5 comes into contact with the corresponding opening 26, 27 in the flexible plate 25 of the sealing plate 20. In the illustrated position of the exemplary embodiment, the blind fitting 4 comes into contact with the opening 26 and thereby raises or lowers the sealing plate 20 in accordance with the precise position of the basket, before the connection fitting 3 moves into the corresponding opening 26, 27, which is the opening 27 in the illustrated exemplary embodiment. Once the basket has been fully inserted, a non-illustrated door is closed, and the operation of the dishwasher can be started.

During operation of the dishwasher, for instance at the heightwise position of the basket as shown in FIG. 1, washing fluid to be sprayed by the spray arm 8 is fed into the inflow tube 10 by a non-illustrated recirculating pump through the supply line 2 and through the connection fitting 3. Due to the pressure prevailing in the coupling 11, the sealing plate 20, which according to the invention is freely movable between the housing 12 and the centering plate 15, is thrust along with the flexible plate 25 placed in it in the direction of the supply line 2, and as a result the sealing lips 28, 29 of the flexible plate 25 rest sealingly on the centering plate 15. The conical openings 26, 27 of the flexible plate 25 are made to sealingly contact the connection fitting 3, as seen in FIG. 2, and the blind fitting 4 that protrudes into the coupling 11 and closes the unneeded opening 26. The labyrinthine sealing assembly seen in FIG. 3, between the housing 12 and the centering plate 15, prevents the escape of water from the outer perihery of the housing 12 of the coupling 11.

Due to the free movability of the sealing plate 20, it is easy for the coupling 11 and the fittings 3, 4, 5 attached thereto to find one another. Due to the sealing between the housing 12 and the centering plate 15, between the centering plate 15 and the sealing plate 20 as well as the flexible plate 25, and between the fittings 3, 4, 5 and the openings 26, 27, water losses are effectively prevented. With the configuration according to the invention, a dishwasher of the type referred to at the outset is created in a simple way, in which an assured joining together of the coupling 11 to the fittings 3, 4, 5 is possible regardless of how the basket is loaded, and in which pressure losses in the water supply to the spray arm 8 connected to the coupling 11 through the use of the supply and resultant worsening of the cleaning action are effectively avoided.

We claim:

1. A dishwasher, comprising:

a tub having a side wall;

at least one adjustable-height basket;

a spray arm associated with said basket, said spray arm having a horizontal inlet tube, and said spray arm and said inlet tube being secured to said basket;

a supply line secured to said side wall of said tub;

an open connection fitting protruding toward said inlet tube;

two closed blind fittings protruding toward said inlet tube; and a coupling having a housing, said coupling having an end oriented toward said supply line, said coupling connecting said inlet tube to said supply line, said coupling having two openings formed therein, said connection fitting protruding into one of said openings, and one of said blind fittings protruding into the other of said openings, said coupling having a centering plate at said end and a sealing plate downstream of said centering plate in flow direction, and said sealing plate having flexible sealing lips and being freely movable between said housing and said centering plate.

2. The dishwasher according to claim 1, wherein said coupling has an interior, and said openings have a conical shape narrowing toward said interior.

3. The dishwasher according to claim 1, including a flexible plate inserted into said sealing plate and having sealing lips.

4. The dishwasher according to claim 3, wherein said flexible plate is made of rubber.

5. The dishwasher according to claim 1, wherein said flexible sealing lips are formed onto said sealing plate.

6. The dishwasher according to claim 1, wherein said sealing plate includes a coating of flexible material having said flexible sealing lips.

7. The dishwasher according to claim 1, wherein said connection fitting has a free end, and said blind fittings have conical tips protruding in front of said free end.

8. The dishwasher according to claim 1, wherein said centering plate is secured with snap connections in said housing of said coupling.

9. The dishwasher according to claim 8, wherein said centering plate has an encompassing rim and detent buttons disposed on said encompassing rim, and said detent buttons drop into detent openings formed in said housing.

10. The dishwasher according to claim 1, including a labyrinthine sealing assembly sealing off said centering plate from said housing of said coupling.

11. The dishwasher according to claim 10, wherein said centering plate has an encompassing rim with an inner surface, said housing of said coupling has a sealing edge encompassing said inner surface of said encompassing rim, and said labyrinthine sealing assembly is formed by said encompassing rim and said sealing edge.

12. The dishwasher according to claim 1, wherein said housing of said coupling is integral with said inlet tube.

13. The dishwasher according to claim 1, wherein said housing of said coupling has receptacles and counter holders for longitudinal wires of said basket.

* * * * *